US005100537A

United States Patent [19]

Krause

[11] Patent Number: 5,100,537

[45] Date of Patent: Mar. 31, 1992

[54] WASTE RECYCLING SYSTEM

[75] Inventor: Herbert K. Krause, Bellingham, Wash.

[73] Assignee: Krause Manufacturing, Inc., Bellingham, Wash.

[21] Appl. No.: 529,901

[22] Filed: May 24, 1990

[51] Int. Cl.[5] ..... B07C 7/04

[52] U.S. Cl. ..... 209/2; 209/705; 209/930; 209/935; 414/502; 414/528

[58] Field of Search ..... 209/2, 702, 703, 704, 209/705, 935, 930; 414/502, 528

[56] References Cited

U.S. PATENT DOCUMENTS

| | | | |
|---|---|---|---|
| 2,151,894 | 3/1939 | Cambessedes | 209/935 X |
| 2,588,282 | 4/1952 | Orwin . | |
| 3,305,113 | 2/1967 | Gardner . | |
| 3,340,935 | 9/1967 | Csimma | 171/14 |
| 3,420,211 | 1/1969 | Hartvickson | 119/82 |
| 3,557,685 | 1/1971 | Schroering | 209/930 |
| 3,595,389 | 7/1971 | Morgan et al. | 209/930 |
| 3,858,939 | 1/1975 | Bond et al. | 414/385 X |
| 4,187,775 | 2/1980 | Flender | 209/930 X |
| 4,375,855 | 3/1983 | Floyd | 209/705 |
| 4,511,024 | 4/1985 | Long | 198/346 |
| 4,859,135 | 8/1989 | Neufeldt | 209/399 X |
| 4,978,271 | 12/1990 | Seader | 414/408 X |
| 4,979,528 | 8/1990 | Palik | 209/547 X |
| 4,979,866 | 12/1990 | Croy | 414/525.6 |

FOREIGN PATENT DOCUMENTS

| | | | |
|---|---|---|---|
| 3644603 | 10/1987 | Fed. Rep. of Germany | 209/705 |

*Primary Examiner*—Donald T. Hajec
*Attorney, Agent, or Firm*—Hughes & Multer

[57] ABSTRACT

A waste collecting and recycling system where a portable waste sorting apparatus is located at a first collecting location. Waste from a nearby locality is brought to the collecting location where the recyclable material is sorted out and carried to another location for recycling or possibly further shipment. Then the portable separating apparatus is moved to a second collecting location and the process is repeated. The waste material brought to these locations can in some instances be presorted, with further sorting or separation being accomplished at the collecting locations. Thus, efficiencies are realized in transportation costs and also in effective use of the sorting apparatus.

9 Claims, 2 Drawing Sheets

WASTE RECYCLING SYSTEM

BACKGROUND OF THE INVENTION a. Field of the Invention

The present invention relates to a waste recycling system, and more particularly to a method and apparatus by which recyclable waste can be collected and sorted at various geographically spaced collecting locations and be brought to other locations for recycling, or transportation to recycling facilities, and more particularly to such a system where portable waste separating apparatus can be effectively utilized.

b. Background Art

In recent years, the recycling of waste material has become increasingly important. There are various ways in which this can be accomplished. For example, in some areas people in residential neighborhoods will presort their recyclable waste and place this adjacent to the street for collection, the waste could be sorted, for example, into the waste material which is simply taken to a landfill or the like, and into three other containers, one for metal, one for glass, and another for paper which could possibly be recycled. Then this sorted waste material is taken to a further collection location, which may be a recycling facility, but which may also be a transfer area where the sorted material is transported further to a recycling facility.

At a collection center, there is often provided a system where the potentially recyclable material is further sorted. For example, the recyclable glass is placed on a conveyor which carries the glass by a plurality of work stations where individual workers will sort through the waste material to remove selected classes of material. Specifically, glass of one color may be sorted by one person and placed in a collecting bin, while glass of another color placed in a collecting bin, while glass of another color would be removed by a worker at another location and placed in another bin. Eventually, the sorted material is subjected to a recycling process, and it could be transported one or more further times prior to the actual recycling process.

The sequence of steps described above is simply given by way of example, and there are obviously variations of this. For example, in some instances there is no attempt to pre-sort the recyclable material at residential sites, and all of the waste material is transported to a collecting and sorting location, where there is a sorting apparatus (i.e. an apparatus with the conveyor, workstations, etc.). Also, in many instances recyclable material is collected along with waste material which has no value for recycling and is transported to a sorting location. The non-recyclable material which is sorted out is simply carried to a disposal site such as a landfill.

Another complicating consideration is that there is currently greater environmental sensitivity to the overall process of collection, disposal and recycling of waste material, and the overall process is often subject to regulations, regarding permits and the like. Another important factor is the costs of transportation. For example, the actual recycling process of many material often requires sometimes a rather substantial capital investment in recycling equipment, and in many instances the recycling facility itself may be located many miles from the collection and sorting area, requiring rail or other land transportation over long distances.

A search of the patent literature with regard to the present invention has disclosed a number of patients, these being the following:

U.S. Pat. No. 3,557,685 (Schroering) is directed toward a "solid waste disposal plant", where the solid waste is placed on a first conveyor to a salvage separating area. Then the salvageable material is separated from the nonsalvageable material by depositing the nonsalvageable material onto a second conveyor where it goes through a shredding and compacting apparatus and then deposited in a sanitary landfill.

U.S. Pat. No. 3,595,389 (Morgan et al) shows what is called "Reclamation Method and Apparatus", where there is a plurality of conveyor belts and work stations located along the length of these belts. Patentability is predicated largely on the arrangement of these conveyors relative to each other.

U.S. Pat. No. 4,511,024 (Long) simply shows a conveyor line where there are foldable panels that provide work stations along the length of the conveyor.

U.S. Pat. No. 3,420,211 (Hartvickson) shows what is called a "turkey hauling machine". There is a portable conveying apparatus, and this is arranged so that the turkeys can be moved up the conveyor belt and into the containing area. Then the trailer assembly can be towed away.

U.S. Pat. No. 3,340,935 (Csimma) shows a harvesting machine which travels through a vine crop area, with there being conveyors and also work stations. Another harvesting machine is shown in U.S. Pat. No. 3,305,113 (Gardner) where portable work stations are provided.

U.S. Pat. No. 2,588,282 (Orwin) shows a conveyor with adjacent work activity stations.

SUMMARY OF THE INVENTION

In the system and method of the present invention, waste which is made up at least in part of salvageable material is processed in a manner to provide certain economies and efficiencies. The system and method is utilized in a situation where there is a plurality of geographically spaced waste collecting locations and at least one recycling location geographically spaced from the collecting locations.

There is first provided a portable waste separating apparatus which comprises:

i. a support frame having an operating axis;

ii. a conveyor means arranged to carry waste along the operating axis;

iii. means defining a plurality of work stations on the axis where workers at the stations have access to the waste being carried on the conveying means so as to be able to sort out and collect portions of the waste for collection.

iv. ground locomotion means (desirably in the form of ground wheels) by which the apparatus can be moved between collecting locations.

The waste material, at least part of which is recyclable, is gathered at localities and brought to the collecting locations which are geographically spaced from one another. The portable waste separating apparatus is located at a first one of said collecting locations, and it is operated to separate the recyclable material. Then the recyclable material so separated is moved to a further location, which can be either a location for further shipment or a recycling location.

Then the portable waste apparatus is moved to a second one of the geographically spaced collecting locations, and it is operated to perform a further separating operation. This separated recyclable material from the second location is in turn transported to another location, which can be the same further transfer location or actual recycling center, or another such location or center.

There are a number of possible variations in the system and method of the present invention. For example, the waste material which is to be recycled may comprise at least in part non-recyclable waste material. This non-recyclable waste material would be moved to a disposal site which is either at the collecting location or at a separate disposal location.

Further, the waste material could be subjected to an earlier presorting method, such as people at residences separating the recyclable material into several categories (e.g. glass, metal, and paper products), and the pre-sorted or preseparated material can then be carried to the related collecting location, where a further sorting operation is carried on (e.g. sorting the recyclable glass into several categories). Then this separated material could be carried to another location for further transportation or for actual recycling.

The present invention further comprises the portable recycling apparatus itself, which lends itself particularly to effective use in the system and method of the present invention.

Other features become apparent from the following detailed description.

BRIEF DESCRIPTION OF THE PREFERRED EMBODIMENT

Figure 1:
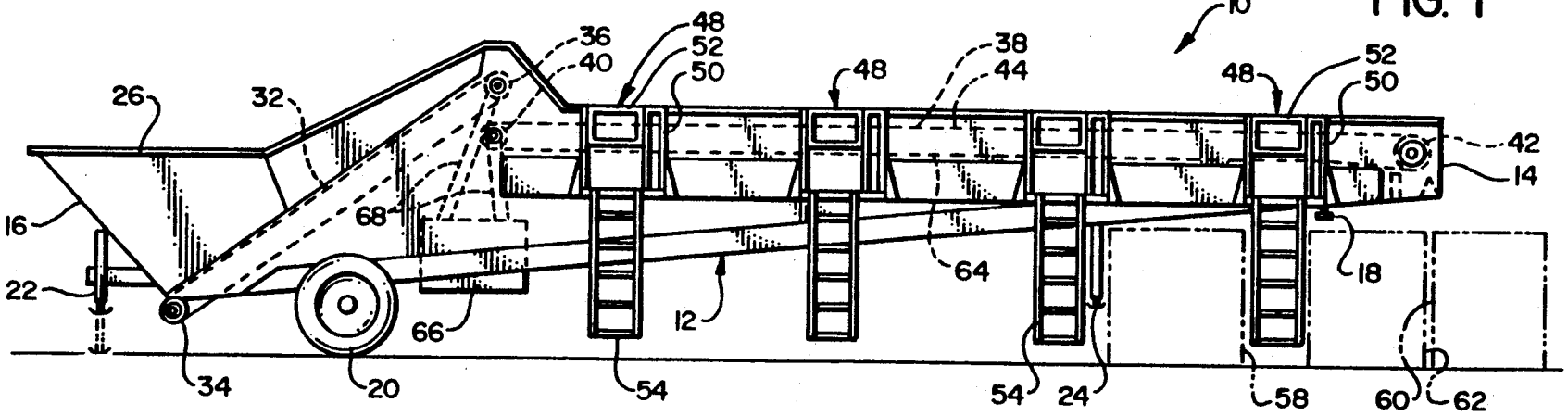
FIG. 1 is a side elevational view of a portable waste separating apparatus included in the present invention.
Figure 2:
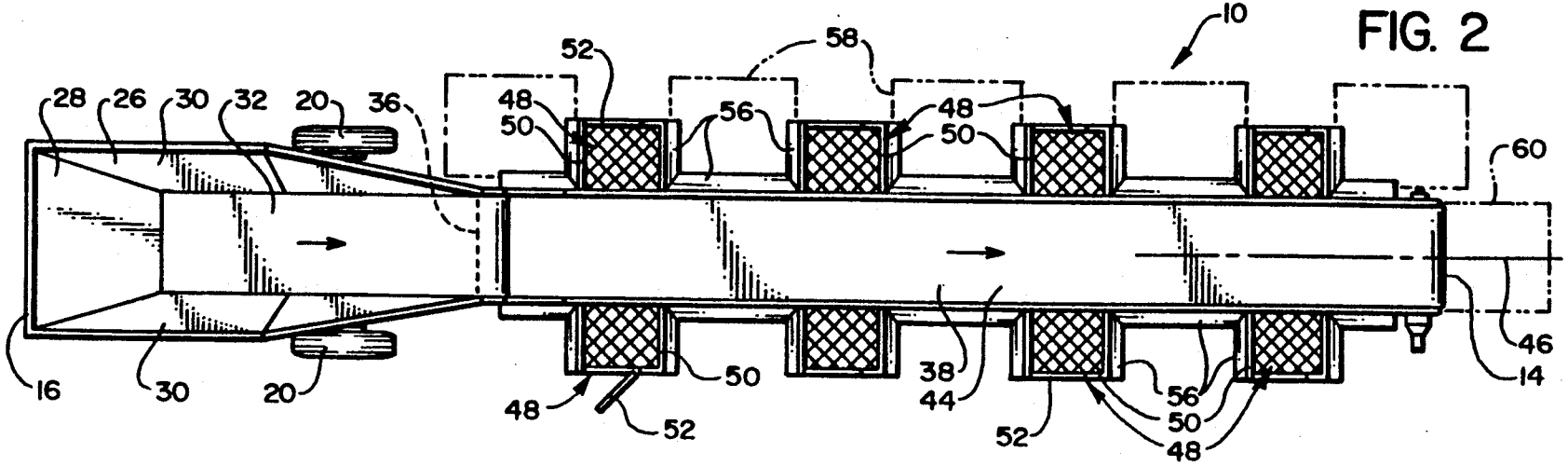
FIG. 2 is a top plan view thereof.

It is believed that a clearer understanding of the present invention will be achieved by first describing, with reference to FIGS. 1 and 2, the portable waste separating apparatus used in the system and method of the present invention.

The waste separating apparatus 10 comprises an elongate support frame 12 having a front end 14 and a rear end 16. At the front end 14, there is a connecting device 18 by which the apparatus 10 can be towed by a tractor or other vehicle. At the rear end 16, there is a pair of ground engaging wheels 20 by which the apparatus 10 can be towed to various locations.

Further, the apparatus 10 comprises stationary ground support means, which are shown herein as rear jacks 22 and forward jacks 24 connected to the frame 12. These jacks 22 and 24 are retracted upwardly for ground travel, and can be lowered into ground engaging position so as to stabilize the apparatus 10 at a stationary location. As shown herein, the jacks 24 are at a raised location, and if necessary, pedestals or other support members can be positioned below the forward jacks 24 to provide the proper support and maintain the forward end of the apparatus 10 at the appropriate height.

The apparatus 10 further comprise a receiving bin 26 into which the waste material to be sorted is deposited. This bin 26 comprises a rear wall 28 and two side walls 30 which slope downwardly and inwardly to a forwardly and upwardly traveling loading conveyor 32 which extends from a lower rear location of a roller 34 to an upper forward location at a roller 36. The waste material to be sorted is dumped into the bin 26 and carried upwardly and forwardly by the loading roller 32 to be discharged off the front end location at 36.

There is a second sorting conveyor 38 which extends from a rear roller 40 (positioned beneath and just rearwardly of the forward end of the conveyor 32) horizontally to a forward roller 42. The sorting conveyor has an upper run 44 which travels in a forward direction, and this conveyor 38 can be considered as having a longitudinal axis 46 along which the waste material to be sorted Is carried. A plurality of work platforms or stations 48 are provided on opposite sides of the sorting conveyor 38, and as shown herein these are provided with suitable safety structure, such as a surrounding rail 50 having an access door 52. Each platform 48 is provided with a related ladder 54 to permit the person to ascend to the location of the platform 48, the ladders 54 being removably mounted so that the apparatus can be more easily transported. Each platform 48 is conveniently located relative to the upper run 44 of the conveyor 38 so that each person can easily reach over the conveyor 38 to pick up selected waste components which that particular person is collecting.

Between the work stations 48, there are collecting locations defined by sidewalls 56 that slope downwardly in a converging pattern. Suitable collecting structure is, in operation, placed at certain collecting locations, such as the collecting bins illustrated schematically at 58.

The roller 42 at the forward end of the apparatus 10 is magnetic so that it attracts magnetically responsive materials (e.g. ferrous metal) to the belt 38. Also, beneath the forward end of the conveyor 38, there is provided a forward bin 60 and an adjacent rear bin 62. These bins 60 and 62 are arranged so that the material which is not attracted to the magnetized roller 42 falls into the forward bin 60, and the material which is attracted to the roller at 42 is carried by the conveyor 38 belt in a semi-circular pattern to begin a rearward path of travel on the lower run 64 of the belt 38, and then drops away into the bin 62 when it moves away from the magnetized roller 42.

The apparatus 10 is provided with suitable power means, such as a diesel motor shown schematically at 66, which has operative drive connections to the two conveyors 32 and 38, these operative connections being shown at 68, to cause movement of the conveyors 32 and 38 by hydraulic motors or the like.

To describe the operation of the apparatus 10, the forward and rear jacks 22 and 24 are raised so as to be out of the engagement of the underlying ground surface, and a tractor or other towing vehicle is connected at 18 to the apparatus 10. In this manner, the apparatus 10 can be towed in the manner of a semi-trailer structure to the site of a waste material collecting location. When the apparatus 10 is positioned for operation, the jacks 22 and 24 are lowered into ground engaging position to stabilize the apparatus 10 on the ground surface. As indicated previously, because of the elevated position of the forward jacks 24, pedestals or the like could be used so that the forward jacks 24 could have proper ground bearing engagement.

The waste material to be recycled is deposited in the bin 6, where the walls 28 and 30 direct the material downwardly onto the feed conveyor 32. The material is carried by the feed conveyor 32 upwardly to drop off the forward end thereof onto the rear end of the sorting conveyor 38. As the waste material is carried along the axis 46 of the conveyor 38, the workers standing on the various work stations or platforms 48 sort through the material on the belt selecting the class of material for which that person is responsible. For example, if the waste material is glass, then one worker may be selecting glass of a particular color.

The material which is not selected travels to the forward end of the conveyor 38 to drop into one or the other of the bins 60 and 62. As indicated previously, with the forward roller 42 being magnetic, the non-magnetic material will fall into the forward bin 60, while the magnetically attracted material will be carried around the circumference of the belt traveling around the roller 42 to fall into the rear bin 62.

Figure 3:
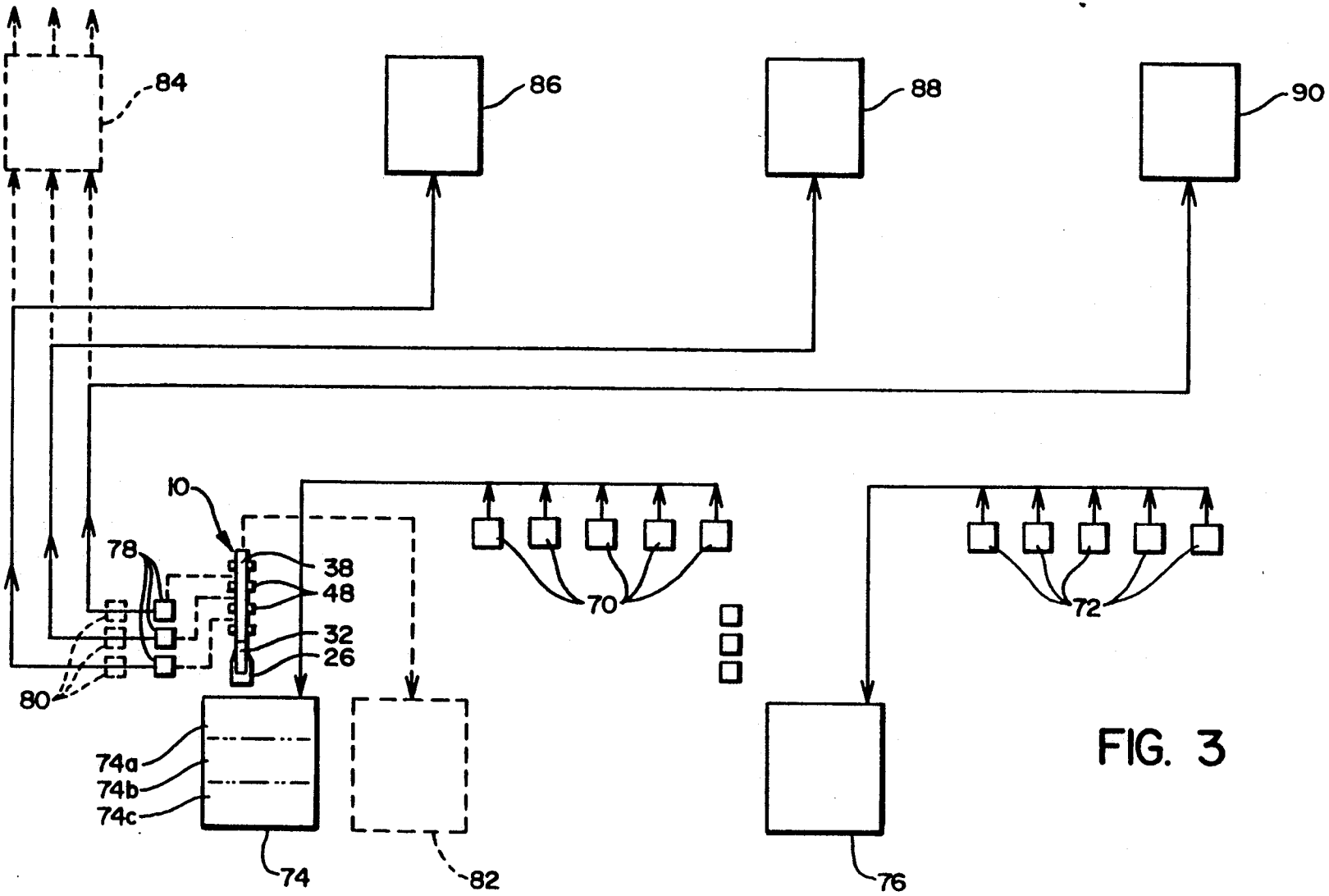
FIG. 3 is a schematic view illustrating the overall system and method of the present invention in which the waste separating apparatus of FIGS. 1 and 2 is employed.

With the foregoing description of the structure and operation of the sorting apparatus 10 in mind, reference is now made in FIG. 3 to describe the overall system and method of the present invention.

Let it be assumed that there is a plurality of household residences 70 in one geographical area, and a plurality of second household residences 72 in another area. Each of these households 70 and 72 is on a program where potentially recyclable material is collected at each house location and moved to a collection station. In some instances, the recyclable waste material may be presorted at the individual household (e.g. into glass, metal, and paper, for example), while in other instances, it will simply be placed together in one container. The waste material from the residences 70 is picked up by, for example, a waste collecting truck and carried to a waste collecting location 74. The waste material collected from the households 72 would be carried to another collecting location 76 which may be closer to those particular households 72.

If the waste material has been presorted, then it will remain sorted when collected by the truck and placed in separate locations at the collecting location 74, such as three separate bins or the like. To illustrate these separate locations, the location 74 is divided by broken lines into three sections 74*a*, 74*b*, or 74*c*, each of which could receive recyclable waste material of a certain type. The waste material is collected at the site 74 for a period of time (e.g. a few days, or possibly a week or two) until there is a sufficient amount of such waste material to warrant an initial sorting operation (or a further sorting operation if the collected material has been presorted).

In the present example, let it be assumed that the waste material has been presorted at the residence location 70 and the sorted portions are placed in the separate locations 74*a*, 74*b*, and 74*c*. At this time, the apparatus 10 of the present invention is towed by a tractor or the like to the collection location 74 and placed in proximity thereto. The apparatus 10, when properly located, has the jacks 22 and 24 lowered into ground engagement to stabilize the apparatus 10. Then the material from one location (e.g. location 74*a*) is continuously loaded into the bin 26 so that the conveyor 32 carries the material onto to the sorting belt or conveyor 38, and workers at the appropriate locations 48 sort the material into the containers 58 as the material travels the length of the conveyor 38.

Then the material from these bins 38 is positioned to be transported, this being indicated at 78. This waste material at 78 may be given a preliminary processing step, such as being compacted, (as in the case of aluminum cans or the like) or possibly baled (in the case of paper products), etc. These processing steps and/or the apparatus for accomplishing the same are simply shown schematically as the broken line squares at 80.

In most instances, the recyclable material, even though presorted by the individual households at 70, will have some waste material that is not practical to recycle. In the present embodiment, this non-recyclable waste material is carried to the end of the conveyor 38 where it is collected in the bins or containers 60 and 62. This nonrecyclable waste material is then carried to a suitable landfill, one such landfill being indicated at 2. It may be that the collecting location 74 is immediately adjacent to the landfill or other disposal site 82, or this site 82 may be a further distance away.

The sorted material deposited in the post-sorted collecting location 78 (possibly with processing at 80) is then transported to a suitable location for actual recycling, or possibly to a transfer location where the recyclable material is shipped to a recycling facility. As indicated previously, in some instances the actual recycling requires a substantial capital investment in recycling apparatus, and such a recycling facility could be a rather long distance from the collecting location, requiring shipment by rail or the like.

In the schematic drawing of FIG. 3, there is shown in broken lines a further transfer location 84, and one option is to move all or part of the material from the post-sorted collecting locations 78 to be carried to the further transfer location 84, from which the material is then transported to a suitable recycling facility.

Yet another option is to take the post-sorted material from the locations 78 and transport these to one or more recycling or transport locations, depending upon the type of material, such locations being indicated at 86, 88 and 90.

When the sorting operation has been completed at the first collecting location 74, then the apparatus 10 is moved to another collecting location, such as the location 76. This is accomplished, as described previously, by raising the ground engaging jacks 22 and 4, and then towing the apparatus 10 to the other location. At the other location, such as shown at 76, essentially the same process is followed as described above with reference to the location at 74.

With the foregoing description in mind, let us now discuss the advantages provided by the system and method of the present invention. First, there is a savings in the expenditure on the sorting apparatus 10. It may be that the collecting facility at the location 74 simply does not have a sufficient volume of waste material to warrant a permanent sorting apparatus. If that were the case, then it would possibly be necessary to carry the recyclable material without further sorting to a more distant location. This would have a number of disadvantages. For example, the handling and rehandling of the material may cause damage (e.g. breaking the glass or the like), and make later sorting more difficult. Further, depending upon the effectiveness of the presorting and collection system, there may be a fair amount of non-recyclable waste material which should be carried to a landfill or the like. By accomplishing the presorting at the collecting location 74, the nonrecyclable waste material can be separated at an early time and carried to the appropriate disposal site or landfill 82. Yet another advantage is that there can be at the collecting location 74 equipment such as a compacter, baler, etc. which would place the recyclable material in a condition so that it can more easily be transported by a truck or the like to another location.

Another advantage is that the apparatus 10 would normally be able to be certified or licensed in accordance with the laws and regulations of that particular locality, so that as soon as it arrives at the collecting location 74, it can promptly begin the operation without need of any further certification or licensing. On the other hand, if each collecting location 74 or 76, etc had its own permanently located sorting apparatus, then there would be the requirement that the collecting facility at 74 or 76 would itself have to take the trouble to be in conformity with such licensing and permit procedures, and also would need to be prepared for periodic inspections if such are carried on in that locality.

Further as indicated previously, the present invention would provide an efficiency ( and accordingly an economizing) in the transportation of the waste material for two reasons. First, the mass of the recyclable waste material to be transported can be reduced by the early separation of the nonrecyclable material at the location 74. Second, the recyclable waste material may be placed in a more desirable form (e.g. compacted or baled) so that it can more readily be transported while occupying a smaller volume.

Further, the fact that the apparatus 10 is portable and thus can be used at a number of collecting facilities, such as at 74 and 76, it is possible to have these collecting and sorting locations be smaller scale in terms of the volume handled , so that these would likely serve smaller localities of the household or the like. This would give better overall quality control or the entire process. For example, let it be assumed that in one local area there was not sufficient awareness of the proper procedures in recycling, and the people in the households were very careless initially, possibly by adding all sort of material which would not properly be recycled. For example, let us assume that the recyclable material collected from the households at (70) were controlled better than those collected form the households at 72. The operators of the apparatus 10 would be able to recognize, during the sorting operation, the deficiencies in the recyclable material collected from the one locality, so that appropriate steps could be taken to monitor the entire operation more closely and thus make the recycling operation more efficient and effective.

It is to be recognized that various modifications could be made to the present invention without departing from the basic teachings thereof.

What is claimed is:

1. A method of processing waste which comprises at least in part salvageable material where there is a plurality of geographically spaced waste collecting locations and at least one recycling location geographically spaced from said waste collecting locations, said method comprising:

a. providing a portable waste separating apparatus comprising:
   i. a support frame having an operating axis;
   ii. a conveyor means arranged to carry waste along said operating axis;
   iii. means defining a plurality of work stations on said axis, where workers at said stations have access to said waste being carried on the conveyor means so as to be able to sort out and collect portions of said waste;
   iv. ground locomotion means for moving said apparatus between said collecting locations;

b. locating said apparatus at a first one of said waste collecting locations and depositing waste material on said conveyor means at said first one of said collecting locations, and separating out the recyclable waste material;

c. transporting said recyclable waste material from said first one of said waste collecting locations to a further location for recycling or for further transportation of the recyclable waste material to a recycling location;

d. locating said apparatus at a second one of said waste collecting locations and depositing waste material on said conveyor means at said second one of said collecting locations, and separating out the recyclable waste material;

e. transporting said recyclable waste material from said second one of said waste collecting locations to a further location for recycling or for further transportation of the recyclable waste material to a recycling location.

2. The method as recited in claim 1, wherein the waste for said first one of said collecting locations is gathered from a first locality where at least some of said waste is presorted prior to the waste being transported to the first one of said collecting locations.

3. The method as recited in claim 2, wherein the presorted waste at said first one of said collecting locations is further sorted into further classes of recyclable waste material.

4. The method as recited in claim 3, wherein non-recyclable waste material is separated at said first one of said collecting locations, and said non-recyclable waste material is deposited at a disposal site.

5. The method as recited in claim 4, wherein said disposal site is geographically separated from said first one of said collecting locations.

6. The method as recited in claim 4, wherein said disposal site is geographically adjacent to said first one of said collecting locations.

7. The method as recited in claim 1, wherein non-recyclable waste material is separated at said first one of said collecting locations, and said non-recyclable waste material is deposited at a disposal site.

8. The method as recited in claim 7, wherein said disposal site is geographically separated from said first one of said collecting locations.

9. The method as recited in claim 7, wherein said disposal site is geographically adjacent to said first one of said collecting locations.

* * * * *